United States Patent [19]

Horie et al.

[11] 4,395,473

[45] Jul. 26, 1983

[54] ELECTROPHOTOGRAPHIC SENSITIVE MATERIALS CONTAINING BARBITURIC ACID OR THIOBARBITURIC ACID DERIVATIES

[75] Inventors: Seiji Horie; Masayoshi Nagata; Junji Nakano; Hideo Sato, all of Asaka, Japan

[73] Assignee: Fuji Photo Film Co., Ltd., Kanagawa, Japan

[21] Appl. No.: 331,745

[22] Filed: Dec. 17, 1981

[30] Foreign Application Priority Data

Jan. 16, 1981 [JP] Japan ..... 56-4734

[51] Int. Cl.[3] ..... G03G 5/00

[52] U.S. Cl. ..... 430/58; 430/76

[58] Field of Search ..... 430/78, 79, 54, 58, 430/59

[56] References Cited

U.S. PATENT DOCUMENTS 3,536,484 10/1970 Dowden et al. ..... 430/76

4,241,157 12/1980 Webster et al. ..... 430/78

*Primary Examiner*—John E. Kittle

*Assistant Examiner*—John L. Goodrow

*Attorney, Agent, or Firm*—Sughrue, Mion, Zinn, Macpeak and Seas

[57] ABSTRACT

An electrophotographic sensitive material is described having an electrophotographic sensitive layer containing a charge generating material and a charge transfer material, wherein said charge generating material comprises a barbituric acid derivative or thiobarbituric acid derivative represented by formula (I) or (II)

(I)

(II)

wherein (i) X represents an oxygen atom or a sulfur atom (ii) $R^1$ represents an alkoxy group, an aralkyl group or a substituted amino group represented by wherein $R^7$ and $R^8$ each represents an unsubstituted or substituted alkyl group or phenyl group, or $R^7$ and $R^8$ together represent a group forming a nitrogen atom-containing heterocyclic ring, (iii) $R^2$ and $R^3$ each represents a hydrogen atom, a halogen atom, an alkyl group, or a lower alkoxy group, (iv) $R^4$ represents a hydrogen atom, an alkyl group, or an unsubstituted or substituted phenyl group, (v) $R^5$ and $R^6$ each represents an alkyl group, an aralkyl group, or an unsubstituted or substituted phenyl group, and (v) $R^5$ and $R^6$ each represents an alkyl group, an aralkyl group, or an unsubstituted or substituted phenyl group, and (vi) Ar represents a group selected from those represented by the formulas

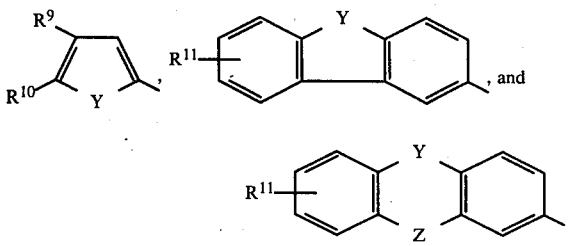

wherein Y and Z each represents S, O or N—$R^{12}$, wherein $R^{12}$ represents an alkyl group having from 1 to 4 carbon atoms, $R^9$ and $R^{10}$ each represents a hydrogen atom, an alkyl group or an alkoxy group, or $R^9$ and $R^{10}$ together represent a group forming a benzene ring or a naphthalene ring, and $R^{11}$, represents a hydrogen atom, an alkyl group, an aralkyl group, an alkoxy group, an aryloxy group, an acyl group, an alkoxycarbonyl group, an aryloxycarbonyl group, a halogen atom, a monoalkylamino group, a dialkylamino group, an amide group, or a nitro group.

11 Claims, 3 Drawing Figures

ELECTROPHOTOGRAPHIC SENSITIVE MATERIALS CONTAINING BARBITURIC ACID OR THIOBARBITURIC ACID DERIVATIES

FIELD OF THE INVENTION

The present invention relates to electrophotographic sensitive materials comprising a charge generating material and a charge transfer material, and more particularly, to electrophotographic materials having an electrophotographic sensitive layer containing a specific barbituric acid derivative or thiobarbituric acid derivative as a charge generating material.

BACKGROUND OF THE INVENTION

The photoconductive process in electrophotographic sensitive materials consists of (1) a step of generating electric charges by exposure, and (2) a step of transferring the electric charges.

An example of carrying out the steps (1) and (2) by means of a single substance includes a selenium plate, which is well known. On the other hand, an example of carrying out the steps (1) and (2) by means of different substances, respectively, include a combination of amorphous selenium and poly-N-vinylcarbazole, which is also well known. The process of carrying out the steps (1) and (2) by means of different substances, respectively, has advantages such as that the choices of selecting materials used for the electrophotographic sensitive materials is expanded, by which electrophotographic properties, such as sensitivity and charge acceptance, etc., of the sensitive materials are improved and that materials suitable for production of a coating layer in the electrophotographic sensitive material can be selected from a broad range.

Hitherto, inorganic substances such as selenium, cadmium sulfide, or zinc oxide, etc., have been used as the photoconductive material in the sensitive material used in electrophotographic processes.

As has been disclosed in U.S. Pat. No. 2,297,691, by Carlson, in the electrophotographic process, a photoconductive material comprising a base coated with a substance which is insulator in the dark, electric resistance of which varies corresponding to exposure by imagewise exposing to light, is used. This photoconductive material is generally electrically charged in the dark after being subjected to dark adaptation for a suitable period of time, This material is then imagewise exposed to light in the form of a radiation pattern which has the effect of reducing surface electric charges corresponding to the relative energy included in the radiation pattern. The surface electric charges or electrostatic latent images remaining on the surface of the photoconductive layer (photosensitive layer) are then brought into contact with a suitable electroscopic indication material, namely, a toner, to form visible images. The toner is allowed to adhere to the surface of the sensitive layer corresponding to the electric charge pattern, whether the toner is contained in an insulating liquid or in a dry carrier. The incidation material adhered on the surface can be fixed by known means such as by heat, pressure, or a vapor of a solvent. Further, the electrostatic latent images can be transcribed on a second base (for example, paper, film, etc.). Likewise, it is possible to develop the electrostatic latent images transcribed onto the second base.

Basic characteristics required for the electrophotographic sensitive materials used in such an electrophotograhic process include the following: (1) the sensitive material can be electrically charged in the dark so as to have a suitable electric potential, (2) the degree of disappearance of electric charges is small in the dark, and (3) the electric charges can be rapidly dispersed by light exposure. However the above described inorganic substances used hitherto have various drawbacks at the same time they have a lot of advantages. For example, selenium, which is widely used at the present time, sufficiently satisfies the above described requirements (1) through (3). However, it has drawbacks in that the cost of production is high because of the severe conditions required for production, in that it is difficult to form into a belt because of lack of elasticity, and that it is necessary to pay attention to handle because it is sensitive to heat and mechanical shock. Cadmium sulfide and zinc oxide have been used as a sensitive material by dispersing in a resin binder, but they can not be repeatedly used, because they have mechanical drawbacks with respect to smoothness, hardness, tensile strength, anti-friction properties, etc.

In the recent years, various electrophotographic sensitive materials using organic substances have been proposed, in order to overcome the drawbacks in the inorganic substances, and some of them have been put to practical use. Examples include a electrophotographic sensitive material comprising poly-N-vinylcarbazole and 2,4,7-trinitrofluorene-9-one (U.S. Pat. No. 3,484,237), a sensitive material composed of poly-N-vinylcarbazole sensitized with a pyrilium dyestuff (Japanese patent publication No. 25658/73), a sensitive material comprising an organic pigment as a main component (Japanese patent application (OPI) No. 37543/72) and a sensitive material comprising an eutectic complex composed of a dye and a resin (Japanese patent application (OPI) No. 10735/72). Although these sensitive materials are believed to have a high practical value because of having excellent characteristics, the fact is that there is not any organic substance which is simply produced, has sufficient electrophotographic characteristics, and sufficiently satisfies requirements for an electrophotograhic process, considering the various requirements for the electrophotographic sensitive materials, such as good wave selectivity required for applying the sensitive material as a laser beam printer or an indication element.

As a result of carrying out studies about the charge generating materials, it has now been found, as will be described in more detail below, that barbituric acid derivatives and thiobarbituric acid derivatives represented by the formulas (I) and (II) described below, and hereinafter referred to as (thio)barbituric acid derivative, are excellent as charge generating materials and sufficiently satisfy all requirements for the electrophotograhic sensitive materials.

Merocyanine dyes having a barbituric acid nucleus or a thiobarbituric acid nucleus have been known as spectral sensitizing dyes for silver salt sensitive materials, and many studies on them have been done in that field. In the recent years, it has been attempted to use these merocyanine dyes as electrophotographic sensitive materials, and, particularly, as electric photosensitive particles for an electrophoretic image forming process, but satisfactory characteristics have not been shown.

An example of using (thio)barbituric acid derivatives as the electrophotographic material has been disclosed in U.S. Pat. No. 3,536,484. However, thiobarbituric acid derivatives used in this U.S. Patent have drawbacks in that they have inferior stability to light, heat, and air oxidation, because a substituted phenyl group is linked to a thioburbituric acid residue through a pentamethine chain having a ring structure, in that synthesis thereof is complicated, and in that they have inferior solubility in organic solvents.

SUMMARY OF THE INVENTION

According to this invention, there has now been found (thio)barbituric acid derivatives having good lightheat- and air oxidation resistances, namely, good stability, wherein a substituted phenyl group or a heterocyclic residue is linked to a barbituric acid residue or a thiobarbituric acid residue through a monomethine chain, which can be synthesized by a simple method by which good quality can be easily obtained.

It has been found that since these (thio)barbituric acid derivatives show an excellent charge generating function, electrophotographic sensitive materials using them as a charge generating material together with a charge transfer material have very high sensitivity. Furthermore, they can be simply produced and have excellent durability and sufficient electrophotographic properties.

Further, it has been found that these electrophotographic sensitive materials have good wave selectivity required for using the electrophotographic sensitive material in a laser beam printer or an indication element, and that the (thio)barbituric acid derivative, which is the charge generating material, and a charge transfer material can be uniformly dispersed, by which sensitive materials having high transparency are obtained.

Therefore the present invention provides:

(1) An electrophotographic sensitive material having an electrophotographic sensitive layer containing a charge generating material and a charge transfer material, wherein said charge generating material is barbituric acid derivatives or thiobarbituric acid derivatives represented by formula (I) or (II).

(I)

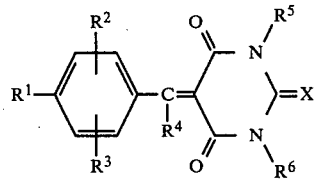

(II)

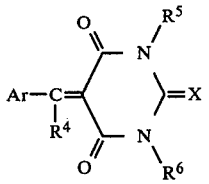

In the formulas (I) and (II), (i) X represents an oxygen atom or a sulfur atom;

(ii) $R^1$ represents an alkoxy group, an aralkyloxy group, or a substituted amino group represented by wherein $R^7$ and $R^8$ (which may be identical or different from each other) each represents an unsubstituted or substituted alkyl group or phenyl group, or $R^7$ and $R^8$ together represent a group forming a nitrogen containing heterocyclic ring;

(iii) $R^2$ and $R^3$ (which may be identical or different from each other) each represents a hydrogen atom, a halogen atom, an alkyl group, or a lower alkoxy group;

(iv) $R^4$ represents a hydrogen atom, an alkyl group, or an unsubstituted or substituted phenyl group;

(v) $R^5$ and $R^6$ (which may be identical or different from each other) each represents an alkyl group, an aralkyl group or an unsubstituted or substituted phenyl group; and (vi) Ar represents a group selected from those represented by the formulas

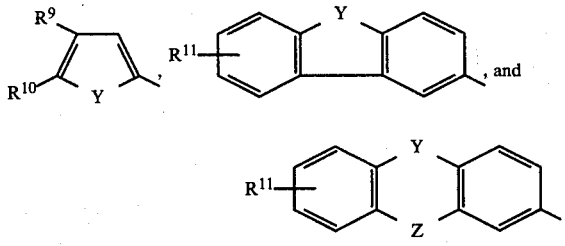

wherein Y and Z (which may be identical or different from each other) each represents S, O or N-$R^{12}$, wherein $R^{12}$ represents an alkyl group having from 1 to 4 carbon atoms, $R^9$ and $R^{10}$ (which may be identical or different from each other) each represents a hydrogen atom, an alkyl group, or an alkoxy group, or $R^9$ and $R^{10}$ together represent a group forming a benzene ring or a naphthalene ring and $R^{11}$ represents a hydrogen atom, an alkyl group, an aralkyl group, an alkoxy group, an aryloxy group, an acyl group, an alkoxycarbonyl group, an aryloxycarbonyl group, a halogen atom, a monoalkylamino group, a dialkylamino group, an amide group, or a nitro group.

(2) An electrophotographic sensitive material as described in (1), wherein said electrophotographic sensitive layer is composed of a single layer containing said charge generating material and said charge transfer material, and (3) electrophotographic sensitive materials described in (1), wherein said electrophotographic sensitive layer is composed of two layers consisting of a charge generating layer containing said charge generating material and a charge transfer layer containing said charge transfer material.

DETAILED DESCRIPTION OF THE INVENTION

Figure 1:
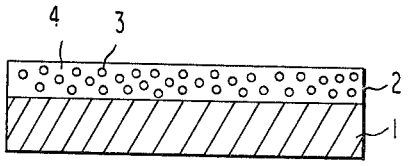
FIGS. 1, 2 and 3 are cross sectional views, enlarged in the thickness direction, of electrophotographic sensitive materials according to the invention, wherein 1 is an electrically conductive base, 2 is an electrophotographic sensitive layer, 3 is a charge generating material, 4 is a charge transfer layer, and 5 is a charge generating layer.

The (thio)barbituric acid derivatives represented by the formulas (I) and (II) are described in further detail below.

X represents an oxygen atom or a sulfur atom.

In case that $R^1$ represents a substituted amino group represented by

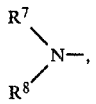

the alkyl group represented by $R^7$ and $R^8$ is an alkyl group having from 1 to 12 carbon atoms, and preferably, from 1 to 4 carbon atoms, examples of which include a methyl group, an ethyl group, a propyl group, a butyl group, etc.

Examples of preferred substituted alkyl group represented by $R^7$ and $R^8$ include (a) alkoxyalkyl such as methoxymethyl, methoxyethyl, ethoxymethyl, ethoxyethyl, ethoxypropyl, methoxybutyl, propoxymethyl, etc., (b) aryloxyalkyl such as phenoxymethyl, phenoxyethyl, naphthoxymethyl, phenoxypentyl, etc., (c) hydroxyalkyl such as hydroxymethyl, hydroxyethyl, hydroxypropyl, hydroxyoctyl, hydroxymethyl, etc., (d) aralkyl such as benzyl, phenetyl, ω,ω-diphenylalky, etc., (e) cyanoalkyl such as cyanomethyl, cyanoethyl, cyanopropyl, cyanobutyl, cyanoethyl, etc., and (f) haloalkyl such as chloromethyl, bromomethyl, bromopentyl, chlorooctyl, etc.

In the case wherein $R^7$ and $R^8$ represent substituted phenyl groups, examples of the substituents thereof include (a) alkyl groups having from 1 to 12 carbon atoms, such as a methyl group, an ethyl group, a straight or branched propyl group, butyl group, a pentyl group or a hexyl group, etc., (b) alkoxy groups having from 1 to 4 carbon atoms, such as a methoxy group, an ethoxy group, a propoxy group, or a butoxy group, (c) aryloxy group, such as a phenoxy group, or an o-, m- or p-tolyloxy group, (d) acyl groups such as an acetyl group, a propionyl group, a benzoyl group, or an o-, m- or p-toluoyl group, (e) alkoxycarbonyl groups having from 2 to 5 carbon atoms, such as a methoxycarbonyl group, an ethoxycarbonyl group, a propoxycarbonyl group or a butoxycarbonyl group, (f) halogen atoms such as a chlorine atom, a bromine atom, or a fluorine atom, (g) monoalkylamino groups substituted by an alkyl group having from 1 to 4 carbon atoms such as a methylamino group, an ethylamino group, or a butylamino group, (h) dialkylamino groups substituted by alkyl groups having from 1 to 4 carbon atoms, such as a dimethylamino group, a diethylamino group, a dipropylamino group, a dibutylamino group, or a N-methyl-N-ethylamino group, (i) amido group such as an acetamido group or a propionamido group, and (j) a nitro group.

Preferred examples of heterocyclic rings formed by $R^7$ and $R^8$ together include heterocyclic rings having the following formulas:

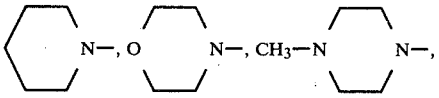

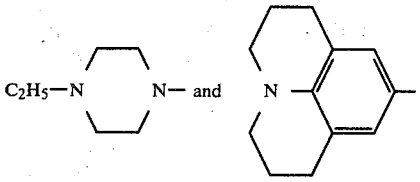

(the group is an embodiment of the group

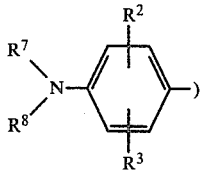

In the case wherein $R^1$ represents an alkoxy group or an aralkyloxy group, examples thereof include a methoxy group, an ethoxy group, a propoxy group, a butoxy group, an octyl group, and a benzyloxy group.

It is particularly preferred that $R^1$ represents a substituted amino group and that $R^7$ and $R^8$ each represents a phenyl group or a tolyl group.

Examples of $R^2$ and $R^3$ include a hydrogen atom, halogen atoms such as a chlorine atom, a bromine atom or a fluorine atom, alkyl groups having from 1 to 4 carbon atoms such as a methyl group, an ethyl group, a propyl group, or a butyl group, and alkoxy groups having from 1 to 4 carbon, atoms such as a methoxy group, an ethoxy group, a propoxy group or a butoxy group. Among them, preferred examples include a hydrogen atom, a methyl group, and a methoxy group.

Examples of $R^4$ include a hydrogen atom, a phenyl group, and alkyl groups having from 1 to 4 carbon atoms, such as a methyl group, an ethyl group, a propyl group or a butyl group. In the case wherein it represents a substituted phenyl group, examples of the substituents include the same groups as those of the substituted phenyl group represented by $R^7$ or $R^8$. Preferred substituents include a hydrogen atom, a methyl group, an ethyl group, a phenyl group, and a p-(dimethylamino)-phenyl group.

Examples of $R^5$ and $R^6$ include alkyl groups having from 1 to 12 carbon atoms, such as a methyl group, an ethyl group, a straight or branched propyl group, a butyl group, a pentyl group or a hexyl group, aralkyl groups such as a benzyl group, a phenetyl group or a benzhydryl group, and a phenyl group.

The above described phenyl group may have substituents. Examples of the substituents include the same groups as those in substituted phenyl groups represented by $R^7$ and $R^8$. Among them, preferred examples include a methyl group, an ethyl group, a phenyl group, or a p-methoxyphenyl group.

Examples of $R^9$ and $R^{10}$ include a hydrogen atom, alkyl groups having from 1 to 4 carbon atoms, such as a methyl group, an ethyl group, a propyl group, or a butyl group, and alkoxy groups having from 1 to 4 carbon atoms, such as a methoxy group, an ethoxy group, a propoxy group, or a butoxy group.

In the case wherein $R^{11}$ represents a unsubstituted or substituted alkyl group or aralkyl group, examples thereof include the same groups as those represented by $R^7$ and $R^8$. Examples of other groups include alkoxy groups having from 1 to 4 carbon atoms such as a methoxy group, an ethoxy group, a propoxy group or a butoxy group, aryloxy groups such as a phenoxy group or an o-, m- or p-tolyloxy group, acyl groups such as an acetyl group, a propionyl group, a benzoyl group or an o-, m- or p-toluoyl group, alkoxycarbonyl groups having from 2 to 5 carbon atoms such as a methoxycarbonyl group, an ethoxycarbonyl group, a propoxycarbonyl group, or a butoxycarbonyl group, aryloxycarbonyl groups such as a benzoyl group, an o-, m- or p-toluoyl group, halogen atoms such as a chlorine atom, a bromine atom or a fluorine atom, monoalkylamino groups substituted by an alkyl group having from 1 to 4 carbon atoms such as a methylamino group, an ethylamino group or a butyl amino group, dialkylamino groups substituted by alkyl groups having from 1 to 4 carbon atoms such as a dimethylamino group, a diethylamino group, a dipropylamino group, a dibutylamino group, or a N-methyl-N-ethylamino group, amido groups such as an acetamido group or a propionamido group, and a nitro group.

Examples of Ar include 5-member heterocyclic rings, such as a 2-furyl group, a 2-thienyl group, a 1-methyl-2-pyrrolyl group or a 5-methyl-2-thienyl group, condensed heterocyclic groups including a 5-member heterocyclic ring, such as a 2-benzo-(b)thienyl group, a 2-naphtho(2,3-b)thienyl group, a 9-ethylcarbazol-2-yl group, or a dibenzothiophen-2-yl group, and condensed heterocyclic groups including a 6 member heterocyclic ring such as a 2-phenoxthinyl group, a 10-ethylphenoxazin-3-yl group, or a 10-ethylphenothiazin-3-yl group.

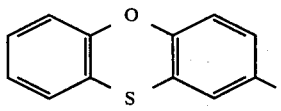

2-phenoxthinyl group

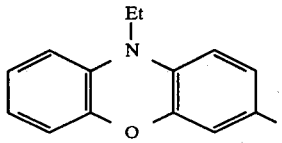

10-ethylphenoxazin-2-yl

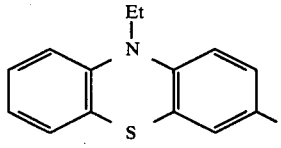

10-ethylphenothiazin-3-yl

Among them, preferred example include a 5-methyl-2-thienyl group, a 2-benzo(b)thienyl group, a 9-ethylcarbazol-2-yl group, a dibenzothiophen-2-yl group, and a 10-ethylphenothiazin-3-yl group.

Particular examples of the (thio)barbituric acid derivatives represented by formula (I) and (II) are described below:

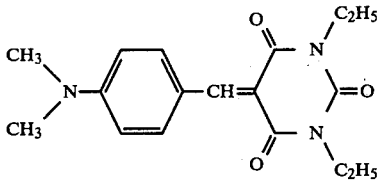

(1)

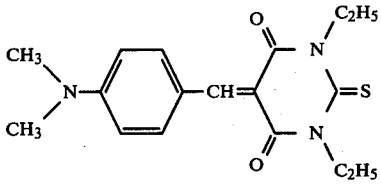

(2)

-continued

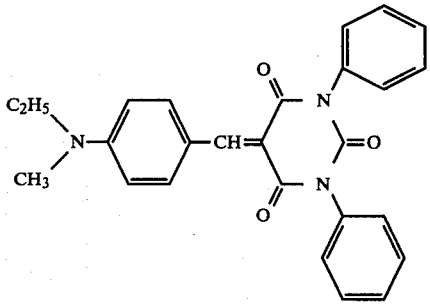

(3)

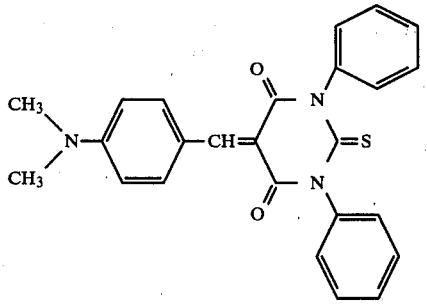

(4)

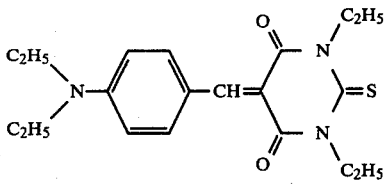

(5)

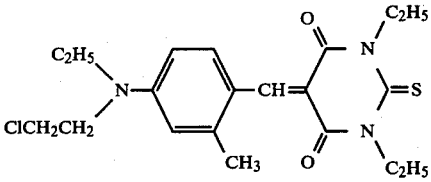

(6)

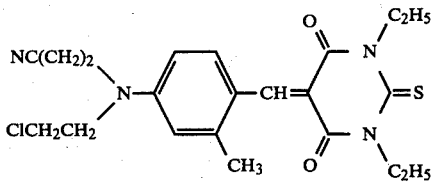

(7)

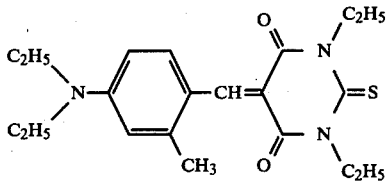

(8)

-continued
(9)
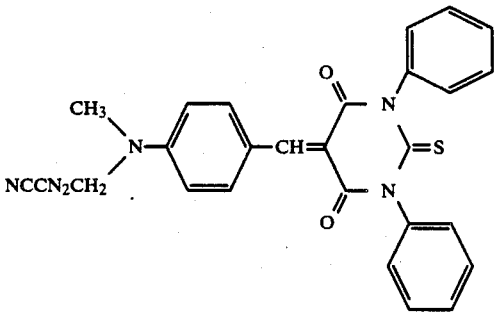
(10)
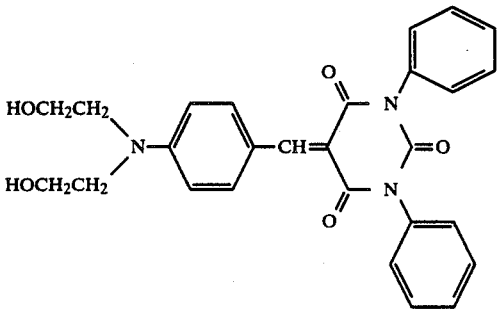
(11)
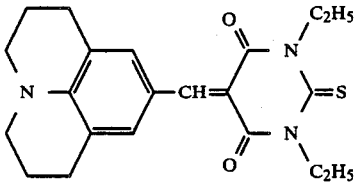
(12)
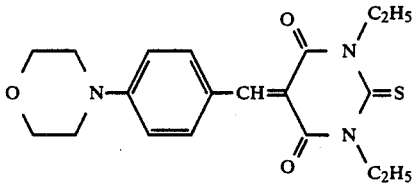
(13)
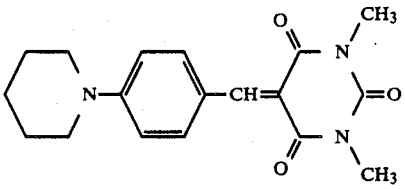
(14)
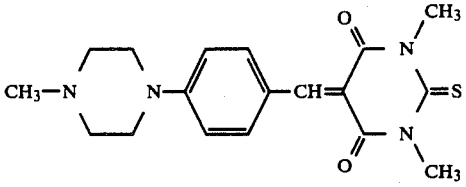
(15)
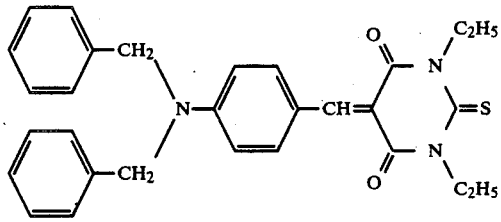
-continued
(16)
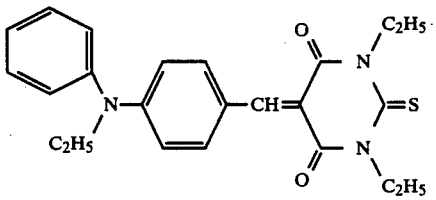
(17)
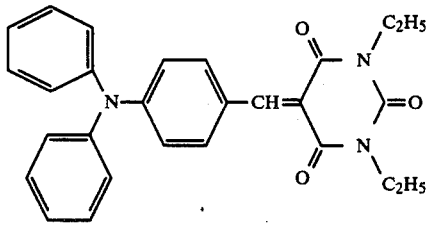
(18)
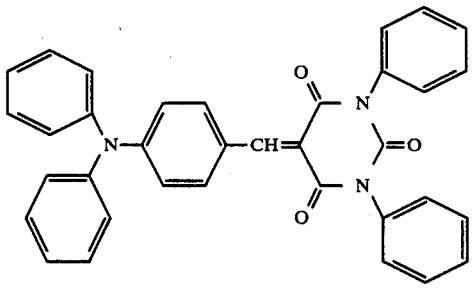
(19)
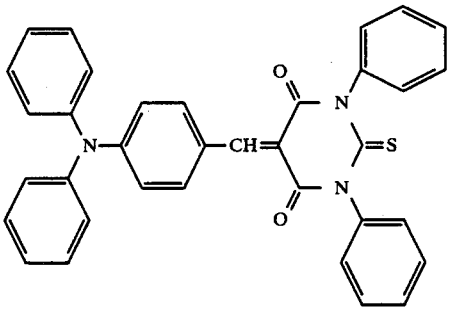
(20)
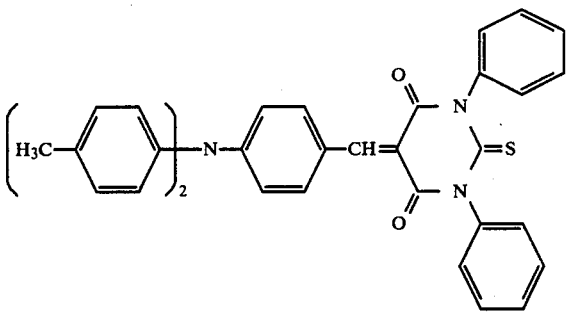

-continued
(21)
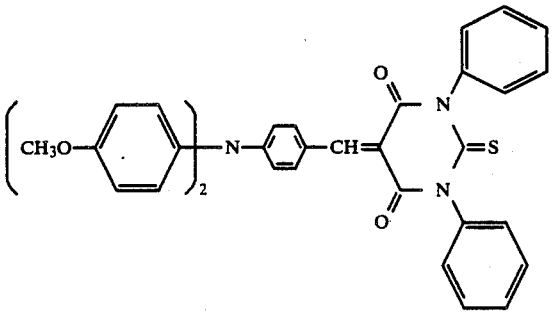
(22)
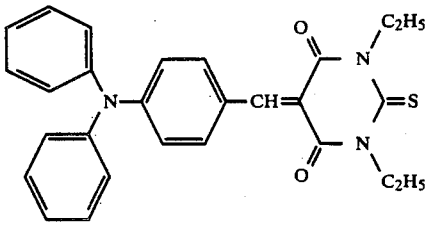
(23)
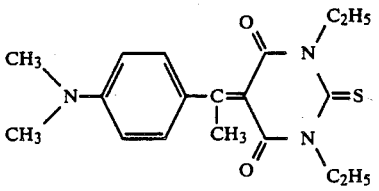
(24)
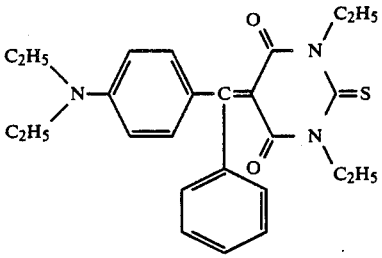
(25)
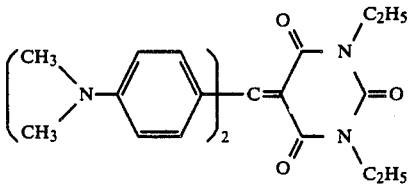
(26)
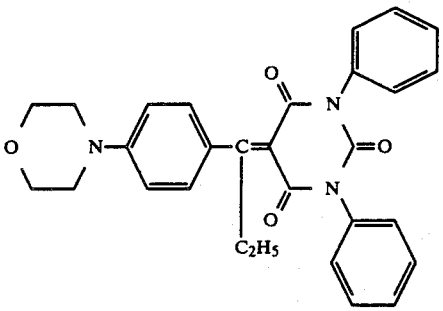
-continued
(27)
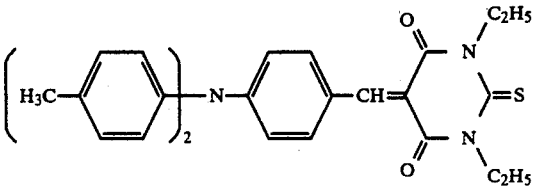
(28)
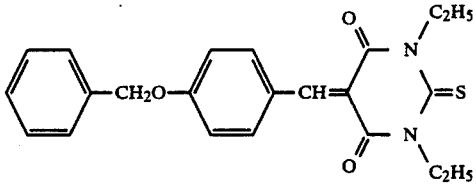
(29)
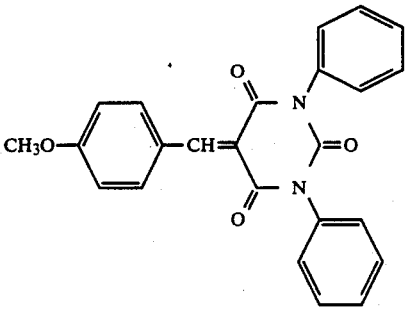
(30)
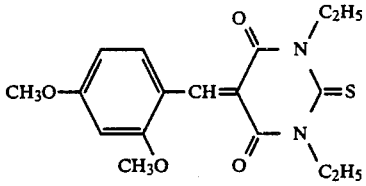
(31)
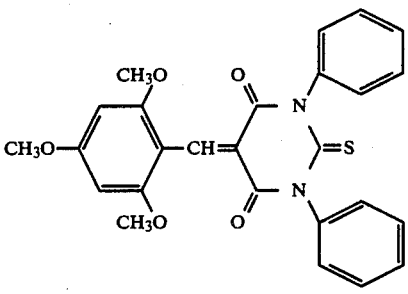
(32)
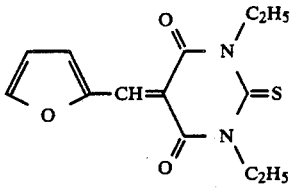
(33)
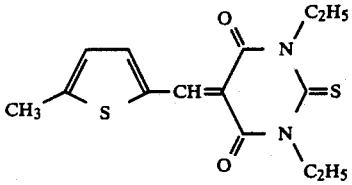

-continued (34)

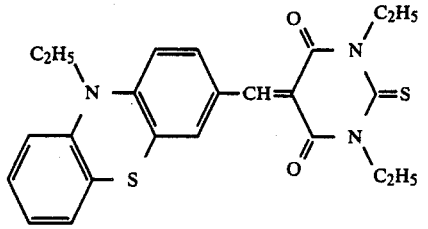

(35)

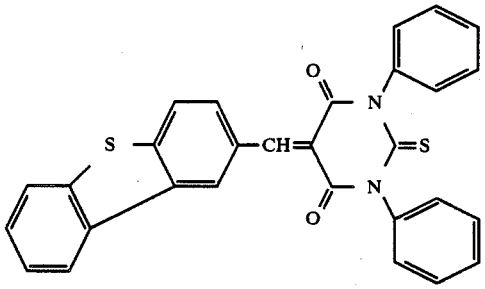

(36)

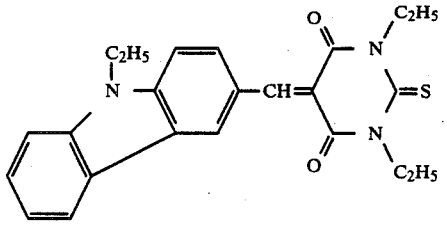

The (thio)barbituric acid derivatives represented by formula (I) and (II) can be easily produced by known methods. None particularly, they can be produced by reacting an aldehyde or ketone represented by formula (III) or (IV) with barbituric acid or thiobarbituric acid having an active methylene group represented by formula (V) in a solvent, and if necessary, adding a small amount of secondary or tertiary amine (piperidine, morpholine, or triethylamine, etc.) as a condensating agent or adding ammonium acetate. If the reaction is difficult, it is preferred to use the aldehyde or ketone in the form of an acetal or imine derivative. As the solvent, alcohols such as methanol or ethanol, etc., aromatic hydrocarbons such as benzene or xylene, etc., dioxane, tetrahydrofuran, N,N-dimethylformamide and acetic acid, etc., can be used, either singly or as mixtures thereof.

(III)

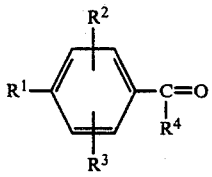

(IV)

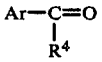

-continued (V)

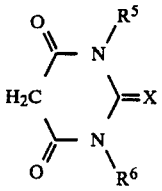

In the formulas (III), (IV) and (V), X, Ar, and $R^1$ through $R^6$ each have the same meaning as in formulas (I) and (II).

The aldehyde compounds represented by the formulas (III) and (IV) (wherein $R^4$ represents a hydrogen atom) can be easily produced by adding an aromatic amine compound or a heterocyclic compound to a Vilsmeier reagent (which is obtained from phosphoryl trichloride ($POCl_3$) and N,N-dimethylformamide) at a low temperature to cause a reaction, and hydrolyzing after the reaction according to the known Vilsmeier process (described in "Ber." Vol. 60, page 119, 1927).

The ketone compounds represented by the formulas (III) and (IV) (wherein $R^4$ represents an alkyl group or an unsubstituted or substituted phenyl group) can be easily produced by reacting an aromatic amine compound and a heterocyclic compound with a corresponding acid chloride in the presence of a Lewis acid catalyst, such as aluminium chloride, etc., according to the known Friedel-Crafts process (described in G. Olah, "Friedel-Crafts and Related Reactions" Vol. 3, Pt 1 and 2 (Interscience Publishers, New York, 1964)).

The barbituric acid and thiobarbituric acid represented by the formula (V) can be easily produced by reacting diethyl malonate with a corresponding urea derivative or thiourea derivative in the presence of a basic catalyst according to the process described in L. G. S. Brooker, R. H. Spraque et al "J. Am. Chem. Soc." Vol. 73, p 5326 (1951), and A. J. Vazakas, W. Walden Bennetts, Jr. "J. Med. Chem." Vol. 7 (3), pp 342–344 (1964).

Synthesis Example 1

Synthesis of Compound (22):

46 g of phosphoryl trichloride ($POCl_3$) was added dropwise to 22 g of N,N-dimethylformamide while stirring on a ice bath, and the stirring was continued for about 1 hour to produce a sirupy Vilsmeier reagent. To this reagent, a solution containing 50 g of N,N,N-triphenylamine in 200 ml of N,N-dimethylformamide was added while maintaining on the ice bath. After continued the stirring for about 1 hour, the temperature of the bath was raised to about 90° C., and the mixture was stirred for 2 additional hours. After the reaction, the mixture was cooled to room temperature and pcured into ice. The resulted aqueous solution was neutralized with alkali to form a yellow precipitate. After it was separated by filtration and dried, it was recrystallized with ethyl alcohol to obtain 43 g of p-(N,N-diphenylamino)benzaldehyde.

4 g of the above described aldehyde and 2.93 g of 1,3-diethyl-2-thiobarbituric acid were dissolved in 200 ml of methanol. After refluxing for about 1 hours, the solution was allowed cooled in air to obtain a red precipitate. After it was separated by filtration and dried, it was recrystallized with an ethanol-benzene mixture to obtain 5.6 g of Compound (22); 5-(p-(diphenylamino)-benzylidene)-1,3-diethyl-2-thiobarbituric acid.

Melting point: 150°-152° C.

Synthesis Example 2

Synthesis of Compound (25)

Diethylketal of Michler's ketone was synthesized from Michler's ketone and triethyloxonium tetrafluoroborate according to the process described in H. Meerwein, W. Florian et al., *Annalen der Chemie* Vol. 641, p 1 (1961).

12.7 g of the above described diethylketal and 7.4 g of 1,3-diethyl-2-thiobarbituric acid were added to 100 ml of benzene. After refluxing for about 1 hour, the mixture was cooled in air, by which a violet precipitate was obtained. After it was separated by filtration and dried, it was recrystallized with a benzene-n-hexane mixture solvent to obtain 14.1 g of Compound (25): 5-bis-(p-(dimethylamino)phenyl)methylene 1,3-diethyl-2-thiobarbituric acid.

Melting point: 93.5°-95° C.

Synthesis Example 3

Synthesis of Compound (19)

1,3-Diphenyl-2thiobarbituric acid was synthesized from malonic acid and thiocarbanilide according to the process described in A. J. Vazakaz, W. W. Bennetls, Jr., "Journal of Medicinal Chemistry" Vol. 7, p 342 (1963)).

10 g of the above described thiobarbituric acid and 9.2 g of p-(diphenylamino)benzaldehyde were dissolved in 250 ml of ethanol. After refluxing for about 1 hour, the mixture was cooled in air, by which a red precipitate was obtained. After it was separated by filtration and dried, it was recrystallized with ethanol to obtain 16.5 g of Compound (19): 5-(p-(diphenylamino)-benzylidene)-1,3-diphenyl-2-thiobarbituric acid.

Melting point; 206°-206.5° C.

Synthesis Example 4

Synthesis of Compound (4)

10 g of 1,3-diphenyl-2-thiobarbituric acid was dissolved in 500 ml of benzene with heating.

To the resulting solution, a solution containing 5.4 g of p-(dimethylamino)benzaldehyde in 100 ml of ethanol was added dropwise. Simultaneously with the addition, the solution became red and a red precipitate was obtained. After stirring for about 2 hours, the precipitate was separated by filtration and washed several times with 100 ml of hot ethanol. After dried, 12.0 g of Compound (4): 5-(p-(dimethylamino)benzylidene)-1,3-diphenyl-2-thiobarbituric acid was obtained.

Melting point: 289°-289.5° C.

Other compounds can be synthesized from corresponding aldehyde and 1,3-diethyl-2-thiobarbituric acid by the same basic procedure as described above. Examples of such compounds and the melting points thereof are described below.

Compound (5)

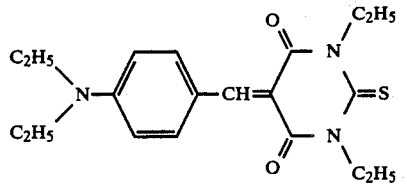

mp 171.5-172.2° C.

-continued

Compound (6)

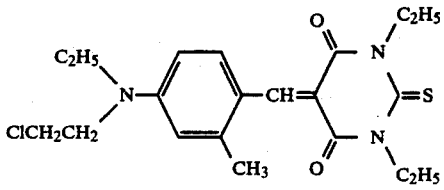

mp 141.7-142.8° C.

Compound (15)

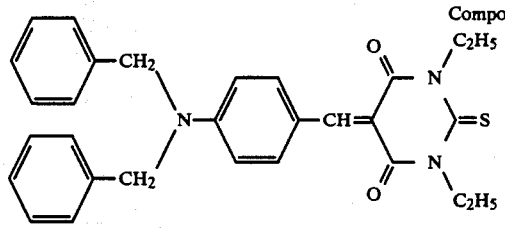

mp 196° C.

Compound (16)

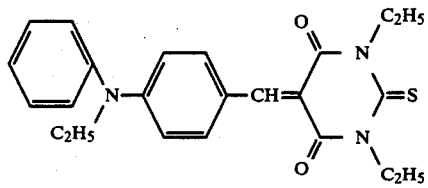

mp 167-167.6° C.

Compound (34)

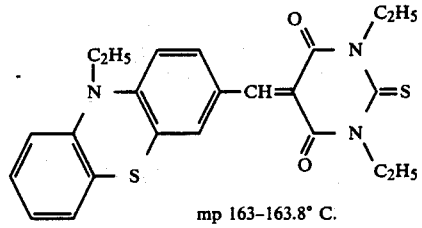

mp 163-163.8° C.

Compound (36)

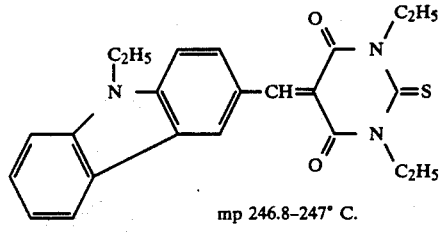

mp 246.8-247° C.

The electrophotographic sensitive material preferably comprise an electrically conductive base and an electrophotographic sensitive layer formed thereon.

Figure 2:
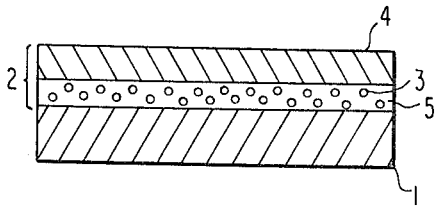
Figure 3:
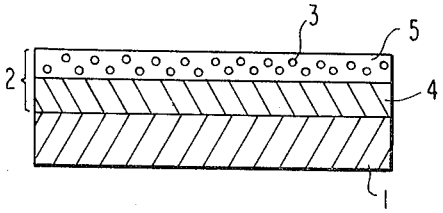

In the electrophotographic sensitive materials of the present invention, the above described (thio) barbituric acid derivatives are used as a charge generating material together with a charge transfer material as a combination, applications of which are shown in FIG. 1 to FIG. 3.

In an electrophotographic sensitive material as is shown in FIG. 1, an electrophotographic sensitive layer 2 wherein a (thio)barbituric acid derivative 3, which is a charge generating material, is dispersed in a charge transfer medium 4 composed of a charge transfer material and a binder, is provided on an electrically conductive base 1, at least the surface of which is electrically conductive.

In the sensitive material shown in FIG. 2, an electrophotographic sensitive layer 2 consisting of a charge generating layer 5 comprising a (thio)barbituric acid derivative 3 and a charge transfer layer 4 containing a charge transfer material is provided on an electrically conductive base 1, at least the surface of which is electrically conductive.

In the sensitive material shown in FIG. 3, an electrophotographic sensitive layer 2 consisting of a charge transfer layer 4 containing a charge transfer material, and a charge generating layer 5 comprising a (thio)barbituric acid derivative 3 on said charge transfer layer, is provided on an electrically conductive base 1, at least the surface of which is electrically conductive.

The sensitive material shown in FIG. 1 can be produced by dispersing a (thio)bartituric acid derivative in a solution containing the charge transfer material and the binder, and applying the resulting dispersion to the electrically conductive base and drying.

The sensitive material shown in FIG. 2 can be produced as follows. The electrically conductive base is covered with the (thio)barbituric acid derivative, which is a charge generating material, by vacuum evaporation or by applying a dispersion prepared by dispersing the (thio)barbituric acid derivative in a suitable solvent containing, if desired, a binder, and drying. Afterwards, if necessary, the surface is finished or the thickness of the layer is adjusted by buffing, etc. Then a solution containing the charge transfer material and a binder is applied to the surface and dried. The application can be carried out by conventional means, for example, by a doctor blade, a wire bar, etc.

The sensitive material shown in FIG. 3 can be produced by applying a solution containing the charge transfer material and binder to the electrically conductive base by a conventional means and drying, and, thereafter, providing the charge generating layer by the same means as in the sensitive material shown in FIG. 2.

The thickness of the electrophotographic sensitive layer in the sensitive material shown in FIG. 1 is from 3 to 50 μm, and preferably from 5 to 20 μm. Further, in the sensitive materials shown in FIG. 2 and 3, the thickness of the charge generating layer is 5 μm or less, and preferably, 2 μm or less, and the thickness of the charge transfer layer is from 3 to 50 μm, and preferably from 5 to 20 μm.

In the sensitive material shown in FIG. 1, an amount of the charge transfer material in the sensitive layer is from 10 to 150% by weight, and preferably from 30 to 100% by weight, based on the weight of the binder, and an amount of the (thio)barbituric acid derivative is from 1 to 150% by weight and preferably from 5 to 50% by weight based on the weight of the binder.

In the sensitive materials shown in FIGS. 2 and 3, the amount of the charge transfer material in the charge transfer layer is from 10 to 150% by weight, and, preferably from 30 to 100% by weight, as in the case of the electrophotographic sensitive layer in FIG. 1, and the amount of the (thio)barbituric acid derivative in the charge generating layer is from 1 to 150% by weight and preferably from 5 to 50% by weight based on the weight of the binder, the charge generating layer being possible to contain the charge transfer material in an amount of from 10 to 150% by weight and preferably from 30 to 100% by weight based on the weight of the binder. In the electrophotographic sensitive materials shown in FIGS. 1, 2 and 3, it is possible to use a plasticizer together with the binder, if desired.

In the electrophotographic sensitive materials of the present invention, as the electrically conductive base, at least the surface of which is electrically conductive, it is possible to use metal plates or metal foils, such as of aluminium, etc., plastic films coated with metal, such as aluminium, etc., by vapor deposition, and paper subjected to conduction treatment. As the binder, condensation resins such as polyamide, polyurethane, polyester, epoxy resin, polyketone, polycarbonate, etc., and vinyl polymers such as polyvinyl ketone, polystyrene, poly-N-vinylcarbazole, polyacrylamide, etc., are used. However, any resin may be used provided that it has an insulating property and an adhesive property.

Examples of useful plasticizers include biphenyl, biphenyl chloride, o-terphenyl, p-terphenyl, dibutyl phthalate, dimethylglycol phthalate, dioctyl phthalate, triphenyl phosphate, methylnaphthalene, benzophenone, chlorinated paraffin, polypropylene, polystyrene, dilaurylthiodipripionate, 3,5-dinitrosalicyclic acid, fluorohydrocarbons, etc.

Examples of charge transfer materials capable of use in the electrophotographic sensitive materials shown in FIGS. 1, 2, and 3 include triphenylamine derivatives as described in U.S. Pat. No. 3,567,450, Japanese patent publication No. 35702/74, German Pat. (DAS) 1,110,518, etc., polyarylalkane derivatives ad described in U.S. Pat. No. 3,542,544, Japanese patent publication No. 555/70, Japanese patent application (OPI) No. 93224/76 (the term "OPI" as used herein refers to "published unexamined Japanese patent application"), etc., pyrazoline derivatives as described in Japanese patent applications (OPI) Nos. 72231/77 and 105537/74 and Japanese patent publication No. 4188/77, etc., and hydrazone derivatives as described in U.S. Pat. No. 3,717,462, Japanese patent applications (OPI) Nos. 59143/79 (corresponding to U.S. Pat. No. 4,150,987), 52063/80, 52064/80, 46760/80 and 85495/80 and Japanese patent application No. 85495/80, etc. Two or more of these charge transfer materials may be used in combination, if desired.

In the present invention, a sensitive wavelength range can be controlled by using two or more (thio)barbituric acid derivatives having each a different sensitive wavelength range, and it is also possible to control the sensitive wavelength range so as to correspond to the wavelength of the irradiated light by using known dye sensitizers together, such as cationic dyes, e.g., crystal violet, etc.

Furthermore, in electrophotographic sensitive materials obtained as described above, it is possible to provide, if necessary, a subbing layer or a barrier layer between the electrically conductive base and the sensitive layer. Examples of materials using in these layers include polyamide, nitrocellulose, and aluminium oxide, etc. These layers preferably have a thickness of 1 μm or less.

The sensitive materials of the present invention have very high sensitivity, and the process for producing them is relatively simple. Furthermore, they have excellent durability. Further, they have an advantage that wave selectivity required for applying the electrophotographic sensitive material to a laser beam printer or an indication element is remarkably high.

Below, the present invention is illustrated in greater detail by examples. However, the present invention is not limited to these examples provided that there is no departure from the gist of the invention. In the following examples, all parts are by weight.

EXAMPLE 1

4 parts of a hydrazone compound having the formula below, which was the charge transfer material, and 5 parts of polycarbonate of bisphenol A were dissolved in 130 parts of dichloromethane.

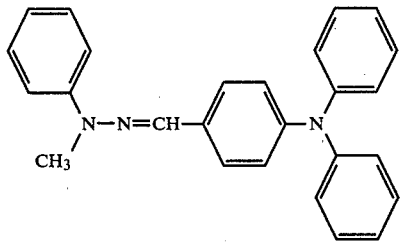

To the resulting solution of the charge transfer material, 2 parts of the thiobarbituric acid derivative (19) were added and dissolved therein to prepare a coating solution for the electrophotographic sensitive layer.

This coating solution was applied to an electrically conductive transparent base (which had a vapor deposited layer of indium oxide on a polyethylene terephthalate base of 100 μm; surface resistance: $10^3\Omega$) by means of a wire wound rod, and it was dried to obtain a sensitive material having a single layer type electrophotographic sensitive layer having a thickness of about 8 μm.

This sensitive material was electrically charged positively by corona discharging at +5 KV using a testing machine for electrostatic copying paper (SP—428, produced by Kawaguchi Electric Co.) and it was then exposed to light by a tungsten lamp of 3000° K. so that the surface had an illuminance of 5 luxes. When the half decay exposure: $E_{50}$ (lux.sec) was measured by determining the period of time necessary to reduce the surface electric potential to half of the initial surface electric potential, $E_{50}$ was 12.0 luxes.sec.

EXAMPLE 2

4 parts of 4,4'-bis-(diethylamino)-2,2'-dimethyl triphenylmethane which was the charge transfer material and 5 parts of polycarbonate of bisphenol A were dissolved in 130 parts of dichloromethane.

To the resulted solution of the charge transfer material, 2.5 parts of the thiobarbituric acid derivative (22) were added and dissolved therein to prepare a coating solution for the electrophotographic sensitive layer.

This coating solution was applied by the same manner as in Example 1 and it was dried to obtain a sensitive material having a single layer type electrophotographic sensitive layer having a thickness of 7 μm.

When sensitivity was measured by the same manner as in Example 1, $E_{50}$ was 24.2 luxes.sec.

EXAMPLES 3–22

Sensitive materials having a single layer type electrophotographic sensitive layer were produced by the same procedure as in Example 2, except that (thio)barbituric acid derivatives shown in the following Table 1 were used instead of the charge generating material in Example 2.

$E_{50}$ was measured by the same manner as in Example 2, and values shown in Table 1 were obtained.

TABLE 1

| Example | Compound number of barbituric acid derivative | $E_{50}$ (lux · sec) |
|---|---|---|
| 3 | (1) | 180 |
| 4 | (2) | 40.2 |
| 5 | (6) | 34.2 |
| 6 | (7) | 28.0 |
| 7 | (8) | 81.6 |
| 8 | (11) | 63.6 |
| 9 | (12) | 43.2 |
| 10 | (15) | 34.8 |
| 11 | (16) | 43.2 |
| 12 | (17) | 52.0 |
| 13 | (18) | 48.6 |
| 14 | (19) | 24.0 |
| 15 | (22) | 24.0 |
| 16 | (23) | 60.1 |
| 17 | (28) | 114 |
| 18 | (30) | 78.0 |
| 19 | (32) | 160 |
| 20 | (33) | 82.8 |
| 21 | (34) | 28.2 |
| 22 | (36) | 27.0 |

EXAMPLE 23

A sanded aluminium plate having a thickness of 100 μm was coated with the thiobarbituric acid derivative (4) by vacuum evaporation under $2\times10^{-5}$ Torr at an evaporation temperature of 300° C. for 15 minutes to form a charge generating layer having a thickness of 0.5 μm.

Then, 5 parts of 4,4'-bis-(diethylamino)-2,2'-dimethyltriphenylmethane which was the charge transfer material and 4 parts of polycarbonate of bisphenol A were dissolved in 100 parts of dichloromethane. The resulting solution as applied to the above described charge generating layer by a revolving coating method, and it was dried to obtain an electrophotographic sensitive material having a laminate type electrophotographic sensitive layer having a thickness of 7 μm.

When the sensitivity was measured by the same manner as in Example 1, $E_{50}$ was 81.0 luxes.sec.

EXAMPLE 24

An electrophotographic sensitive material having a laminate type electrophotographic sensitive layer was obtained by the same procedure as in Example 23, except that the thiobarbituric acid derivative (19) was used instead of the charge transfer material in Example 23.

When the sensitivity was measured by the same manner as in Example 1, $E_{50}$ was 29.3 luxes.sec.

While the invention has been described in detail and with reference to specific embodiments thereof, it will be apparent to one skilled in the art that various changes and modifications can be made therein without departing from the spirit and scope thereof.

What is claimed is:

1. An electrophotographic sensitive material having an electrophotographic sensitive layer containing a charge generating material and a charge transfer material, wherein said charge generating material comprises a barbituric acid derivative or thiobarbituric acid derivative represented by formula (I) or (II)

(I)

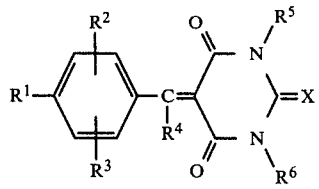

(II)

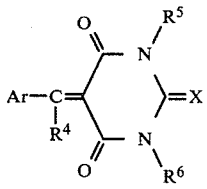

wherein (i) X represents an oxygen atom or a sulfur atom, (ii) $R^1$ represents an alkoxy group, an aralkyl group or a substituted amino group represented by

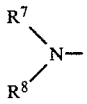

wherein $R^7$ and $R^8$ each represents an unsubstituted or substituted alkyl group or phenyl group, or $R^7$ and $R^8$ together represents a group forming a nitrogen atom-containing heterocyclic ring, (iii) $R^2$ and $R^3$ each represents a hydrogen atom, a halogen atom, an alkyl group, or a lower alkoxy group, (iv) $R^4$ represents a hydrogen atom, an alkyl group, or an unsubstituted or substituted phenyl group, (v) $R^5$ and $R^6$ each represents an alkyl group, an aralkyl group, or an unsubstituted or substituted phenyl group, and (vi) Ar represents a group selected from those represented by the formulas

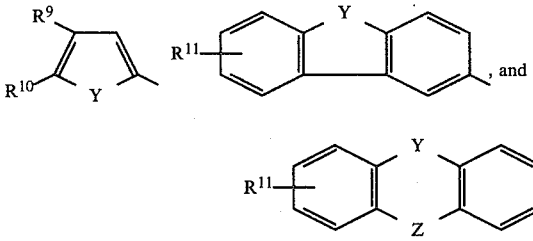

wherein Y and Z each represents S, O, or N-$R^{12}$, wherein $R^{12}$ represents an alkyl group having from 1 to 4 carbon atoms, $R^9$ and $R^{10}$ each represents a hydrogen atom, an alkyl group or an alkoxy group, or $R^9$ and $R^{10}$ together represent a group forming a benzene ring or a naphthalene ring, and $R^{11}$ represents a hydrogen atom, an alkyl group, an aralkyl group, an alkoxy group, an aryloxy group, an acyl group, an alkoxycarbonyl group, an aryloxycarbonyl group, a halogen atom, a monoalkylamino group, a dialkylamino group, an amido group, or a nitro group.

2. An electrophotographic sensitive material according to claim 1, wherein said electrophotographic sensitive layer is composed of a single layer containing said charge generating material and said charge transfer material.

3. An electrophotographic sensitive material according to claim 1, wherein said electrophotographic sensitive layer is composed of two layers, consisting of a charge generating layer containing said charge generating material, and a charge transfer layer containing said charge transfer material.

4. An electrophotographic sensitive material according to claim 2, wherein the thickness of the electrophotographic sensitive layer is from 3 to 50 μm.

5. An electrophotographic material according to claim 2, wherein the thickness of the electrophotographic sensitive layer is from 5 to 20 μm.

6. An electrophotographic sensitive material according to claim 3, wherein the thickness of the charge generating layer is 5 μm or less and the thickness of the charge transfer layer is from 3 to 50 μm.

7. An electrophotographic sensitive material according to claim 3, wherein the thickness of the charge generating layer is 2 μm or less and the thickness of the charge transfer layer is from 5 to 20 μm.

8. An electrophotographic sensitive material as in claim 2, 4, or 5, wherein the electrophotographic sensitive layer comprises a charge generating material, a charge transfer material, and a binder, and the amount of the charge transfer material is from 10 to 150% by weight based on the weight of the binder, and the amount of barbituric acid derivative or thiobarbituric acid derivative is from 1 to 150% by weight based on the weight of the binder.

9. An electrophotographic sensititive material as in claim 2, 4, or 5, wherein the electrophotographic sensitive layer comprises a charge generating material, a charge transfer material, and a binder, and the amount of the charge transfer material is from 30 to 100% by weight based on the weight of the binder, and the amount of barbituric acid derivative or thiobarbituric acid derivative is from 5 to 50% by weight based on the binder.

10. An electrophotographic sensitive material according to claim 3, 6, or 7, wherein the electrophotographic sensitive layer is composed of a charge generating layer containing said charge generating material and a binder, and a charge transfer layer containing said charge transfer material and binder, wherein the amount of charge transfer material in the charge transfer layer is from 10 to 150% by weight, based on the weight of the binder.

11. An electrophotographic sensitive material according to claim 3, 6, or 7, wherein the electrophotographic sensitive layer is composed of the charge generating layer containing said charge generating material and a binder, and a charge transfer layer containing said charge transfer material and binder, wherein the amount of charge transfer material in the charge transfer layer is from 30 to 100% by weight, based on the weight of the binder.

* * * * *